United States Patent [19]

Brackmann et al.

[11] 3,951,049

[45] Apr. 20, 1976

[54] METHOD AND APPARATUS FOR FORMING PACKAGING STRUCTURES

[75] Inventors: Warren A. Brackmann, Cooksville; Daniel DiIanni, Toronto; Arthur K. Bunnell; Karel Hrboticky, both of Etobicoke, all of Canada

[73] Assignee: Carling O'Keefe Limited, Toronto, Canada

[22] Filed: June 5, 1975

[21] Appl. No.: 584,000

[52] U.S. Cl. ..... 93/39 R; 53/38; 53/41; 53/287; 93/51 R; 93/55.1 P

[51] Int. Cl.[2] ..... B31B 17/02

[58] Field of Search ..... 53/287, 38, 41; 93/39 R, 39.1 R, 39.1 P, 55, 55.1 R, 55.1 M, 55.1 P, 36.3, 36 MM, 51 R, 49 R, 36 R, 44

[56] References Cited

UNITED STATES PATENTS

| | | | |
|---|---|---|---|
| 3,065,679 | 11/1962 | Clement | 93/55.1 P |
| 3,105,334 | 10/1963 | Marshall | 53/38 |
| 3,501,895 | 3/1970 | Geyer | 53/287 |
| 3,634,995 | 1/1972 | Curtis | 53/38 |
| 3,913,300 | 10/1975 | Benzing | 53/287 |

*Primary Examiner*—James F. Coan
*Attorney, Agent, or Firm*—Sim & McBurney

[57] ABSTRACT

Method and apparatus are provided to package beer bottles in a reusable tray with a sleeve to be used just once. A blank for the sleeve is wrapped around the tray to grip the side and end walls of the tray and close the open top and cooperating parts of the blank are glued together to provide the finished structure.

21 Claims, 12 Drawing Figures

METHOD AND APPARATUS FOR FORMING PACKAGING STRUCTURES

FIELD OF INVENTION

This invention relates to the formation of packaging structures.

BACKGROUND TO THE INVENTION

In the packaging of bottled beer, there has recently been suggested in U.S. Pat. No. 3,815,808 to provide a packaging structure, especially for beer bottles, which consists of a substantially rigid tray which may be reusable several times and typically constructed of plastic material and a disposable sleeve which closes the open top of the tray. The disposable sleeve includes downwardly depending panels integrally formed with a top panel coextensive with the open top of the tray, the downwardly depending panels extending substantially the height of the tray walls and gripping the tray walls thereby inhibiting the removal of the sleeve from the tray. The top panel of the sleeve has an opening means whereby the consumer may gain access to the beer bottles in the tray, the sleeve, however, remaining in association with the tray after opening of the opening means.

The packaging of beer bottles for sale is a high speed generally automated operation requiring precise and reliable machinery. Currently, there is not available packaging machinery suitable for high speed operation in the formation of packaging structures in accordance with the above-mentioned U.S. Pat. No. 3,815,808.

SUMMARY OF INVENTION

The present invention is directed to a method and apparatus for the formation of the packaging structure of the above-mentioned U.S. Pat. No. 3,815,808.

DESCRIPTION OF PREFERRED EMBODIMENTS

Figure 1:
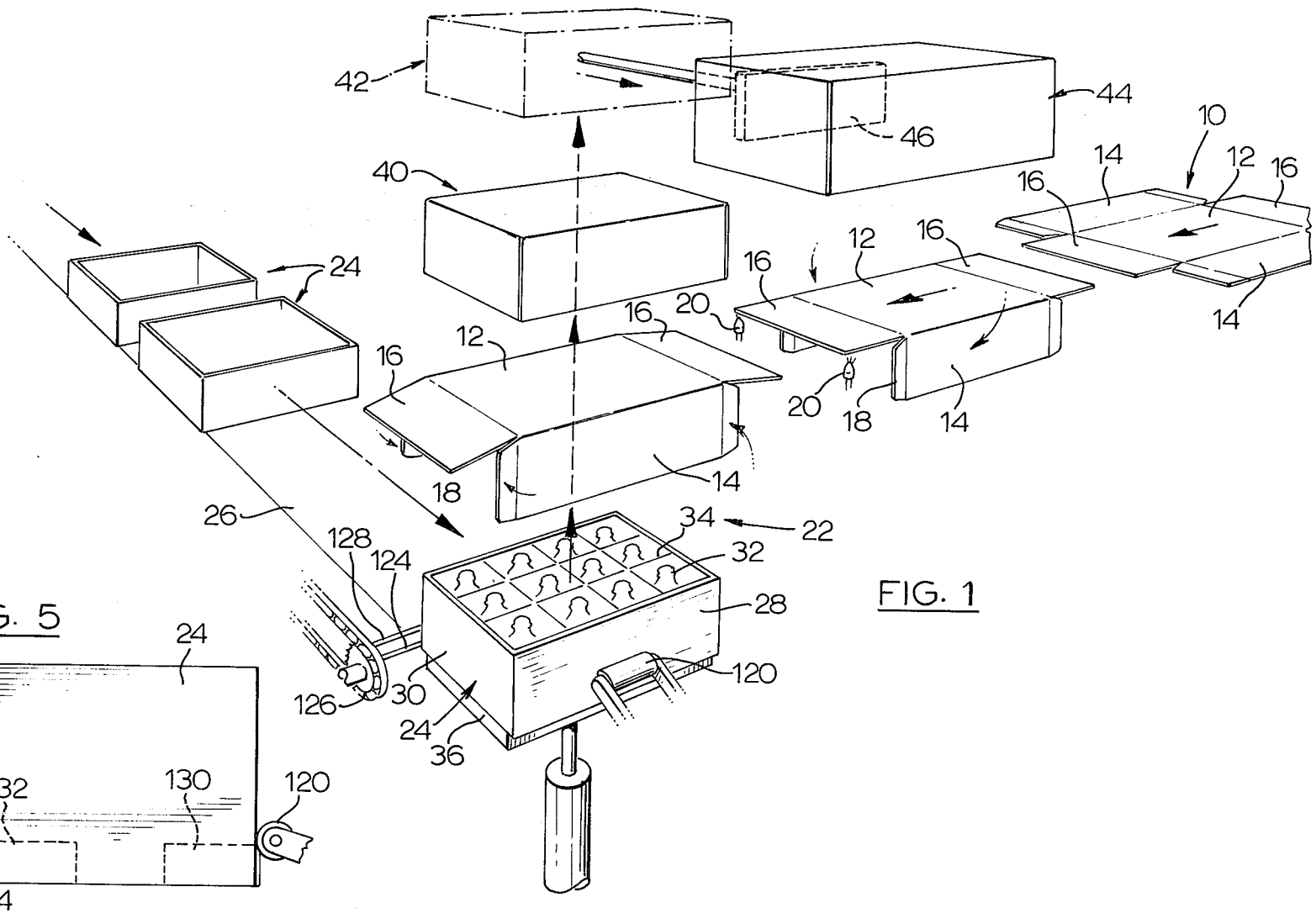
FIG. 1 is a schematic representation of a method and apparatus in accordance with this invention.
Figure 5:
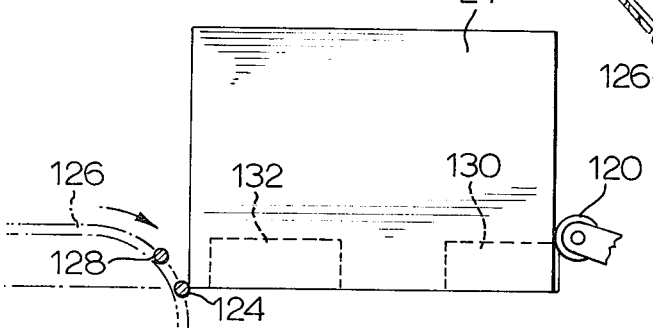
FIG. 5 is an elevational view of another detail of the apparatus of FIGS. 2 and 3.

Referring first to the schematic representation of FIG. 1, there is shown one embodiment of the sequence of operations involved in the present invention in the formation of a packaging structure.

A blank 10 has a central panel 12, side panels 14 and end panels 16 joined thereto through suitable crease lines. Flaps 18 are attached to the lateral edges of the side panels 14 through suitable crease lines. The blank 10 typically is formed from thin cardboard.

Usually the blank 10 has handhole outlines in the end panels 16 and opening means in the top panel 12 but these items have been omitted in FIG. 1 for ease of illustration. Typically, the blank 10 may have the form described in U.S. Pat. No. 3,854,652.

The blank 10 is illustrated in FIG. 1 being fed horizontally in a longitudinal orientation. This orientation is used for ease of operation, although a lateral orientation of the blank 10 may be used, if desired.

The side panels 14 of the blank 10 are folded downwardly and the underside of each end panel 16 immediately adjacent their lateral edges has adhesive applied thereto, such as from the guns shown schematically at 20. The guns 20 are stationary and first apply adhesive to the undersurface of the leading end panel 16 at the lateral edges thereof and then to the undersurface of the trailing end panel 16 at the lateral edges thereof.

The folded and adhesive-applied blank 10 then is forwarded to an assembly station 22 for assembly with a beer tray. A beer tray 24 of any convenient construction is conveyed horizontally on a conveyor shown schematically at 26 to the assembly station 22.

The plane of conveyance of the trays 24 is vertically downwardly spaced from the plane of feed of the blanks 10 so that the tray 24 is located vertically below the blank 10 at the assembly station 22.

The tray 24 may be constructed to contain any desired number of beer bottles, typically 6, 12 or 24 bottles, and may be formed of any convenient material of construction, typically a durable material, such as heavy cardboard or, preferably, synthetic polymeric material.

The tray 24 typically has side walls 28 and end walls 30 upstanding from a base (not shown) a distance substantially equal to the height of the bottles 32 packaged in the tray 24. Divider walls 34 typically are provided to separate the interior of the tray 24 into a plurality of individual compartments in which the beer bottles are positioned.

The side panels 14 and the end panels 16 of the blank 10 are substantially equal in dimension to the side walls 28 and the end walls 30 respectively of the tray 24. The open top of the tray 24 is dimensioned substantially the same as the centre panel 12 of the blank 10.

In the schematic representation of FIG. 1, the direction of feed of the tray 24 is substantially at right angles to the direction of feed of the blank 10, with the trays 24 being fed laterally towards the assembly station 22. This procedure is preferred for ease of provision of suitable equipment and for economic space utilization.

It is possible, however, to provide co-directional feed of blank 10 and tray 24 to the assembly station 22 or feed of tray 24 in the opposite direction from feed of blank 10 to the assembly station 22, with the tray 24 in such operations being fed longitudinally rather than laterally.

At the assembly station 22, the tray 24 is positioned on an elevatable platform 36, or other suitable elevating device, in a location immediately below the blank 10 in alignment with the blank 10 so that, in plan view, the center panel 12 overlies the open top of the tray 24.

Usually the blank 10 is positioned at the assembly station 22 prior to the positioning of the tray 24 thereat. This sequence of operation is utilized for the sake of convenience and the simultaneous positioning or positioning of the tray 24 prior to the blank 10 at the assembly station 22 may be utilized.

When both tray 24 and blank 10 are positioned at the assembly station 22, the tray 24 is elevated vertically upwardly by the platform 36 until the upper periphery of the tray 24 contacts with the centre panel 12 of the blank 10 substantially at the crease line joins with the side panels 14 and the end panel 16. The flaps 18 are folded inwardly towards the end walls 30 of the tray 24. This folding operation may be conducted before commencement of the elevation step or after commencement thereof and before the latter folding of the end panels 16.

The tray 24 is continued to be elevated lifting the blank 10 with it. The end panels 16 are folded downwardly towards and into frictional gripping contact with the end walls 30 of the case 24 and the flaps 18. During this operation, the side panels 14 are moved into and held in frictional gripping engagement with the side walls 28 of the case 30.

The resulting packaging structure 38 is maintained at an adhesive drying or curing station 40 to allow the adhesive on the end panels 16 to join the flaps 18 with the end panels 16. During the adhesive-drying operation, the side panels 14 and the end panels 16 are maintained in their frictional gripping relationship with the walls of the tray 24 so that after the adhesive joining of the end panels 16 and the flaps 18, the resulting packaging structure is in accordance with U.S. Pat. No. 3,815,808.

The packaging structure 38, after the adhesive has dried is elevated to an ejection station 42 for recovery of a packaging structure 44 in accordance with U.S. Pat. No. 3,815,808 and is released from the pressure applied to the side panels 14 and end panels 16 during passage to or at the ejection station 42. Any suitable recovery device, such as a pusher plate 46, may be used.

The sequence of operations has been described above with reference to a single blank 10 and a single tray 24 to form a single final packaging structure 44. Usually, the operation is carried out continuously so that there is a blank 10 and a tray 24 at each phase of the sequence at any given time. Further, when a packaging structure 44 is being ejected, a packaging structure 38 is drying and a blank 10 and a tray 24 are located at the assembly station 22.

To facilitate this continuous procedure, the elevating platform 36 is retracted when the packaging structure 38 is formed, and a separate support and elevator device engages the packaging structure 38 to maintain it separate from the structure 44 above and the blank 10 below.

An apparatus suitable for carrying out the procedure described above with reference to the schematic representation of FIG. 1 is shown in FIGS. 2 to 11. Certain reference numerals common to those used in FIG. 1 are used in the following description of FIGS. 2 to 11.

An elevating platform 110 is situated at the assembly station 22 and is intended to support thereon a tray 24 for vertical elevation. The platform 110 consists of a flat horizontally-positioned plate of dimension in the direction of movement of the tray 24 substantially equal to the lateral dimension of the tray 24 and of a dimension transverse thereto less than the longitudinal dimension of the tray 24. Edges of the platform 110 extending in the direction of motion of the tray 24 are castellated at 112. The reason for the dimensioning and shaping of this platform 110 will become more apparent below.

Figures 2, 4:
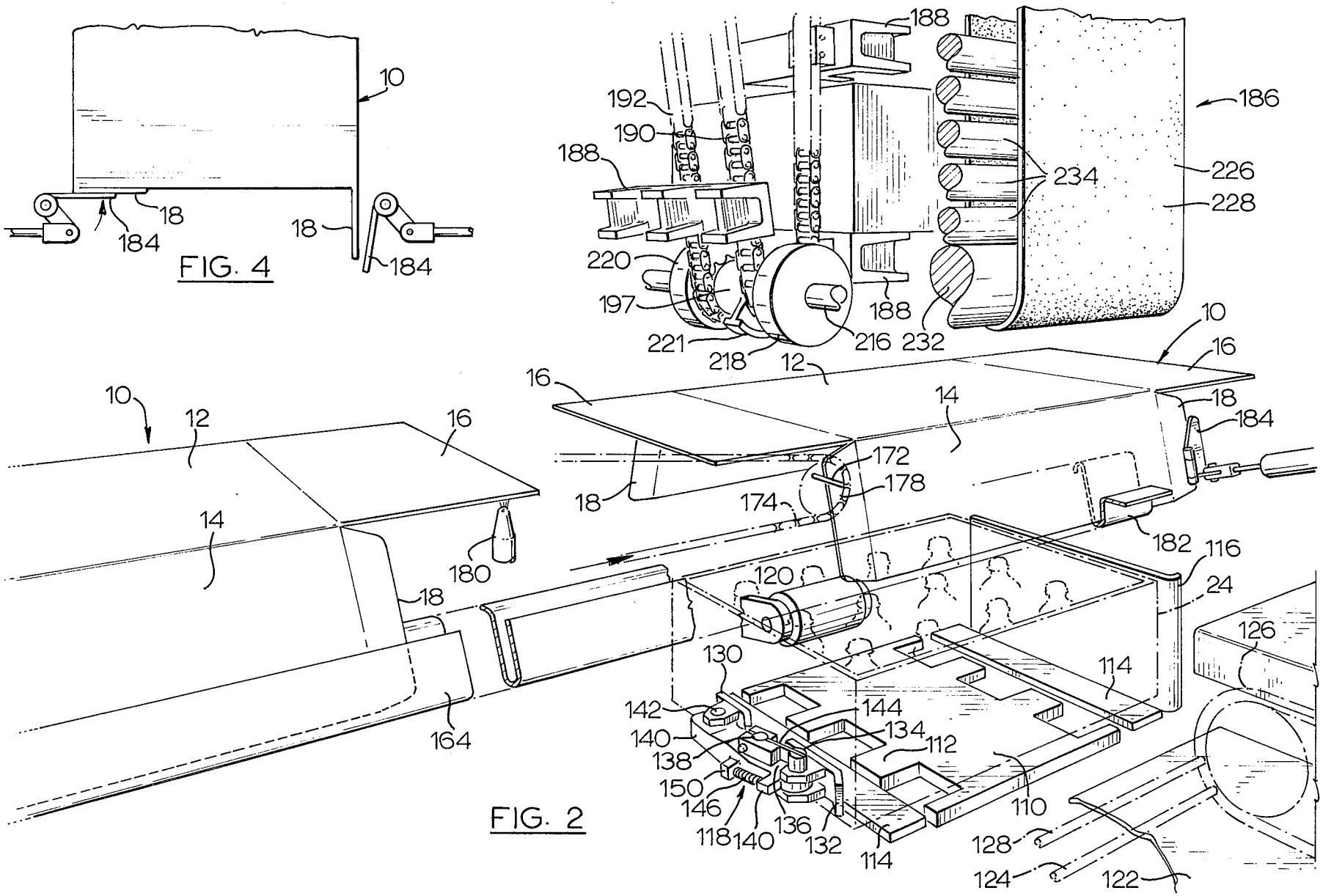
FIG. 2 is a perspective view of part of an apparatus constructed in accordance with this invention.
FIG. 4 is a plan view of a detail of the apparatus of FIGS. 2 and 3.
Figure 8:
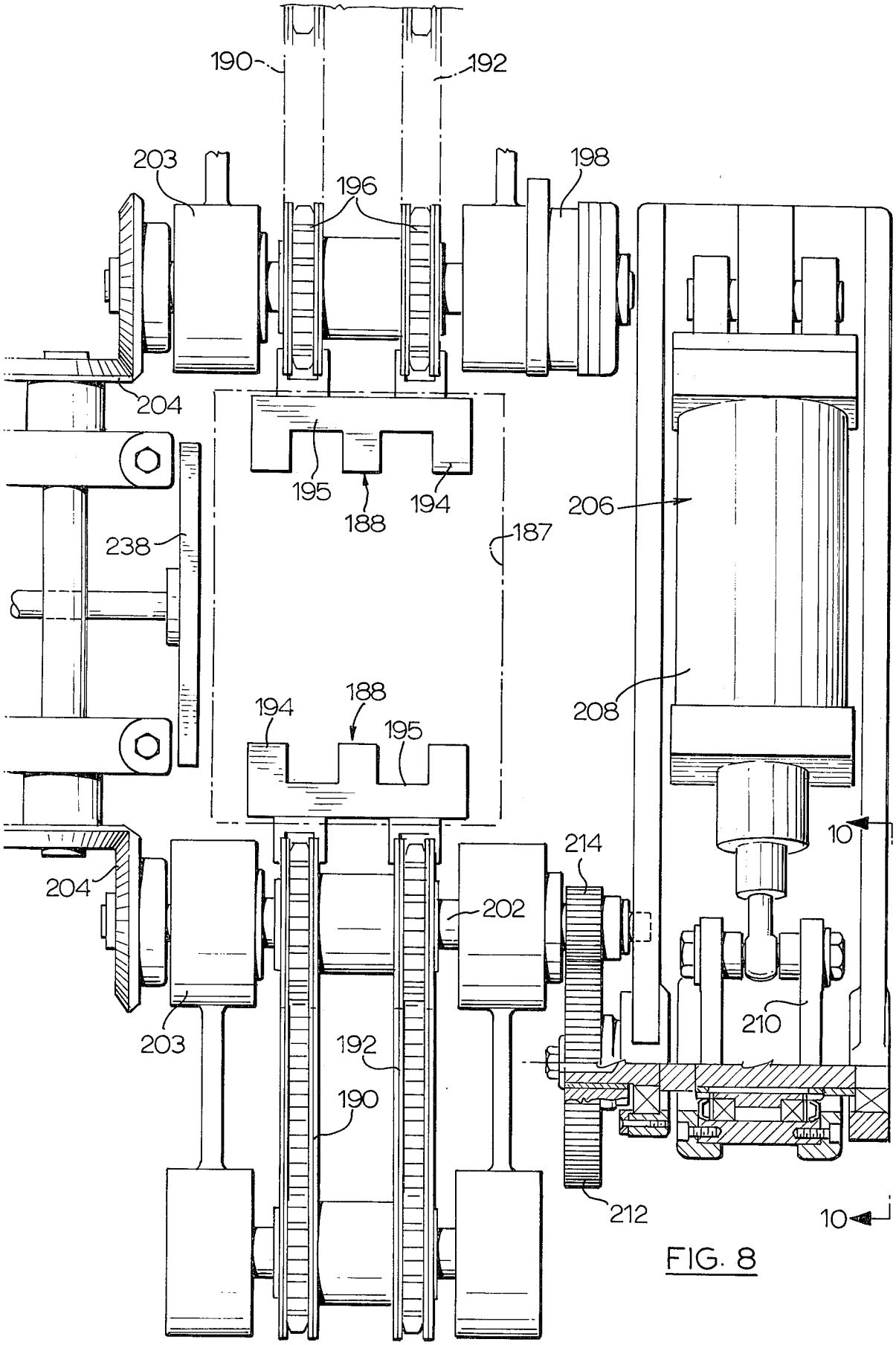
FIG. 8 is a plan view of the central portion of the apparatus of FIGS. 2 and 3.

The platform 110 is vertically reciprocable between its lower extremity as shown in FIG. 2 and its upper extremity as shown in FIG. 8 by any suitable means, typically a pneumatically operated piston. Adjacent and coextensive with the castellated edges 112 of the platform 110 and located slightly above the lower extremity level of the platform 110 are flat horizontally positioned immobile ledges 114, the top surfaces of which are coplanar with the top surface of the platform 110 at its lower extremity. The ledges 114 support the longitudinal extremities of tray 24 when positioned for elevation on the platform 110 with the platform 110 at its lower extremity. A wall 116 in fixed position is provided upstanding from one of the ledges 114 and a brake mechanism 118 is provided adjacent the other of the ledges 114. The distance between the wall 116 and the brake mechanism 118 is substantially the longitudinal dimension of the tray 24 whereby confinement of a tray 28 fed onto the platform 110 between the wall 116 and the brake mechanism 118 causes a braking action on the speed of the tray 24. The wall 116 and brake mechanism 118 also assist in positioning the tray 24 accurately for elevation.

A fixed stop 120 is provided to limit the extent of movement of the tray 28 when delivered to the ledges 114. A suitable conveyor feed 122 is provided to feed the trays 24 onto the platform 110. A pusher bar 124 mounted between driven chains 126 engages the tray 24 during its motion on the conveyor 122 and ejects the tray 24 off the conveyor 122 onto the platform 110. As shown in the detail of FIG. 4, the distance between the pusher bar 124 and the stop 120 at the point of loss of contact of the pusher bar 124 and the tray 24 when the latter is positioned on the ledges 114 is substantially equal to the lateral dimension of the tray 24. This arrangement ensures that the tray 24 is positioned against the stop 120 when located on the ledges 114 at the assembly station 22.

The residual momentum of the tray 24 after the cooperative braking action of the wall 116 and the brake mechanism 118 may cause the tray 24 to rebound upon contact with the stop 120. To ensure that, upon such occurrence, the tray 24 ultimately is positioned in contact with the stop 120 prior to elevation of the platform 110, a second pusher bar 128 is provided connected between the chains 126. Upon any rebound, the second pusher bar 128 arrests the rebound and pushes the tray 24 back into contact with the stop 120.

The stop 120 usually is situated in a fixed location such that when the tray 24 is in contact therewith the tray 24 is correctly positioned for elevation. However, circumstances may arise where it is desired to remove a particular tray 24 positioned at the assembly station 22 and this may be achieved by providing a removal mechanism for the stop 120, so that the particular tray or trays 24 may be ejected out of the assembly station through the side formerly occupied by the stop 120.

The brake mechanism 118 includes two brake pads 130 and 132. Brake pad 132 is pivotally connected by pivot pin 134 to one end of a first arm 136. The arm 136 is pivoted at its other end about fixed pivot pin 138. A second arm 140 also is pivoted at one end thereof about the fixed pivot pin 138 and is pivotally connected to the brake pad 130 at its other end through pivot pin 142.

A spring 144 extends between the fixed pivot pin 138 and the pivot pin 134 to bias the brake pad 132 outwardly and away from the wall 116. A compression spring 146 extends between a projection 148 on the first arm 136 and a projection 150 on the second arm 140 to bias the brake pad 130 inwardly and towards the wall 116.

The biasing of the brake pads 130 and 132 by the springs 144 and 146 in this manner results in engagement of the pad 130 first by the tray 24 fed onto the platform 110 which then causes brake pad 132 to engage the tray 24, so that braking occurs under the action of both brake pads 130 and 132. It is only in the last short distance of travel of the tray 24 that braking occurs.

The combination of the brake mechanism 118, the wall 116, the stop 120 and the pusher bars 124 and 128, however, enables the tray 24 rapidly to be brought to a stop in the assembly station 22 in the precise location for later elevation. This ability allows the feed of a tray 24 to be made at speed and contributes significantly to the operation of the apparatus of FIGS. 2 to 10 rapidly and reliably to form packaging structures.

The brake pads 130 and 132 and the wall 116 have their vertical edges facing the conveyor 122 flanged outwardly to accommodate minor variations in lateral position of the tray 24 upon entry to the assembly station 22.

A blank feeding, folding and adhesive-applying mechanism 152 (FIGS. 6 and 7) includes a rotatable wheel 154 having a peripheral blank-engaging member 155 for feeding individual blanks 10 one at a time from a stack thereof (not shown) between laterally spaced-apart pairs of upper and lower cooperating drive belts 156 and 158.

The drive belts 156 are driven by and mounted on a series of rollers 157 and drive belts 158 similarly are driven by and mounted on a series of rollers 159.

Shaping rods 160 are provided adjacent to the cooperating drive belts 156 and 158 in position to engage the side panels 14 of the blank 10 while the blank is positioned between the belts 156 and 158 and shaped to bend the side panels 14 downwardly about their crease-line joins with the centre panel 12.

Figures 6, 7:
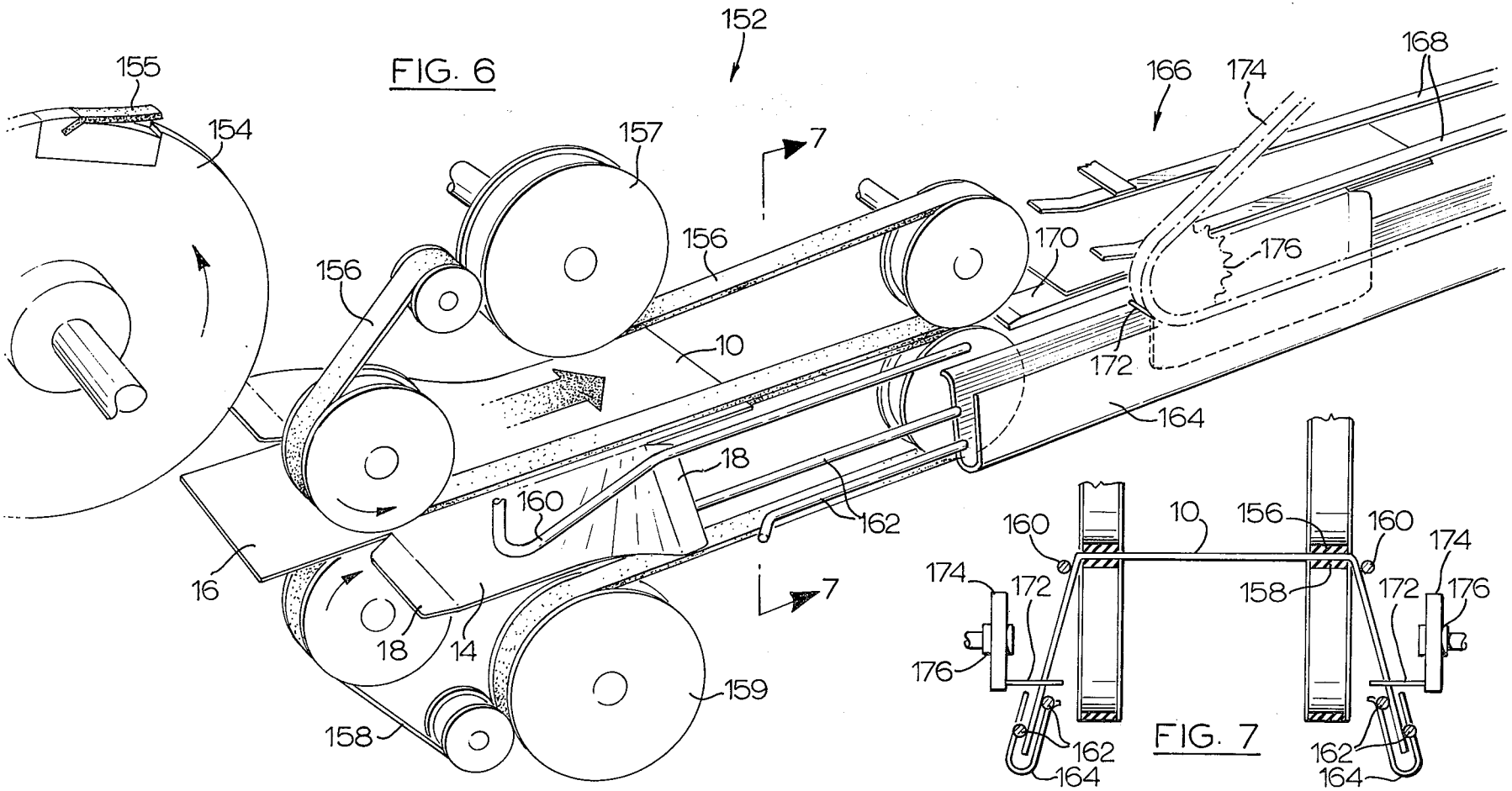
FIG. 6 is a perspective view of a blank folding and feeding device for use with the apparatus of FIGS. 2 and 3.
FIG. 7 is a sectional view of the device of FIG. 5 taken on line 7—7.

Side panel lower edge guiding and confining rods 162 are provided for receiving and constraining therebetween the lower edges of the folded side panels 14 and for leading the same into generally U-shaped channel members 164, as may be seen from the sectional view of FIG. 7.

Immediately adjacent the cooperating drive belts 156 and 158 and downstream of the exit thereof is positioned a blank feed and indexing mechanism 166 including longitudinally extending, laterally spaced-apart, upper-surface-engaging flat rails 168 spaced vertically from a horizontal planar surface 170 for holding the blank therebetween. The upstream ends of the rails 168 are bent upwardly from the horizontal to facilitate receipt of the blank 10 from the drive belts 156 and 158.

A pin 172 is mounted on a chain 174 passing around driving wheels 176 and 178 to engage a rearward edge of the blank 10 and convey the same to the assembly station 22. The pin 172 is driven at the speed required to position one blank 10 at the assembly station 22 at any given time.

Adhesive-applying guns 180 or any other convenient adhesive-applying means are positioned beneath the intended plane of movement of the blank 10 and downstream of the horizontal surface 170 to apply adhesive to the undersurface of the end panels 16 adjacent their lateral edges. While only a single gun 180 is shown in FIG. 2, this is for ease of illustration and a second one is positioned in equivalent location adjacent the other lateral edge of the end panel 16, as may be seen, for example, in the schematic representation of FIG. 1.

Stop means 181 are positioned at the assembly station 22 to limit the extent of movement of the blank 10 once the blank 10 is released from engagement with the pin 172 and to ensure vertical alignment of the centre panel 12 of the blank 10 in the assembly station 22 so that in plan view the centre panel 12 overlies the open top of the tray 24.

Blank supporting brackets 182, only one of which is shown, are positioned at the assembly station 22 to engage and support the lower edges of the side panels 14 of the blank 10.

Flap-engaging, pivotally mounted flange elements 184 (only one of which is shown in FIG. 2) are positioned one adjacent each of the flaps 18 for folding the flaps 18 inwardly, as seen in the detail of FIG. 4. The flange elements 184 are arranged to operate in such a manner that the upstream flaps 18 first are folded and then the downstream flaps 18 are folded, the flange elements 184 at the upstream end holding the blank 10 against movement while the downstream end flaps 18 are folded.

Located vertically above the assembly station 22 is a column-like structure 186 having a rectangular vertical passage 187 therethrough. The rectangular vertical passage 187 is dimensioned in cross-sectional view substantially the same as the packaging structure to be formed and is in vertical alignment in plan view with the tray 24 and the centre panel 12 of the blank 10 located at the assembly station 22.

Mounted for vertical movement upwardly and through the vertical passage 187 are tray supporting members 188. Each of the tray supporting members 188 is connected between a pair of chains 190 and 192, two of such pairs of chains 190 and 192 being provided, on opposite sides of the passage 187. The tray supporting members 188 are mounted on the chains 190 and 192 so that they are arranged in horizontally opposed pairs in the passage 187 thereby to support from below a tray 24 located in the passage 187.

Each tray supporting member 188 has an E-shaped cross-section in plan view with teeth 194 projecting from an elongate portion 195. The elongate portion 195 is dimensioned in plan view substantially the same as the plate members 114 and the teeth 194 are dimensioned to pass through the castellation 112 of the platform 110.

Figure 9:
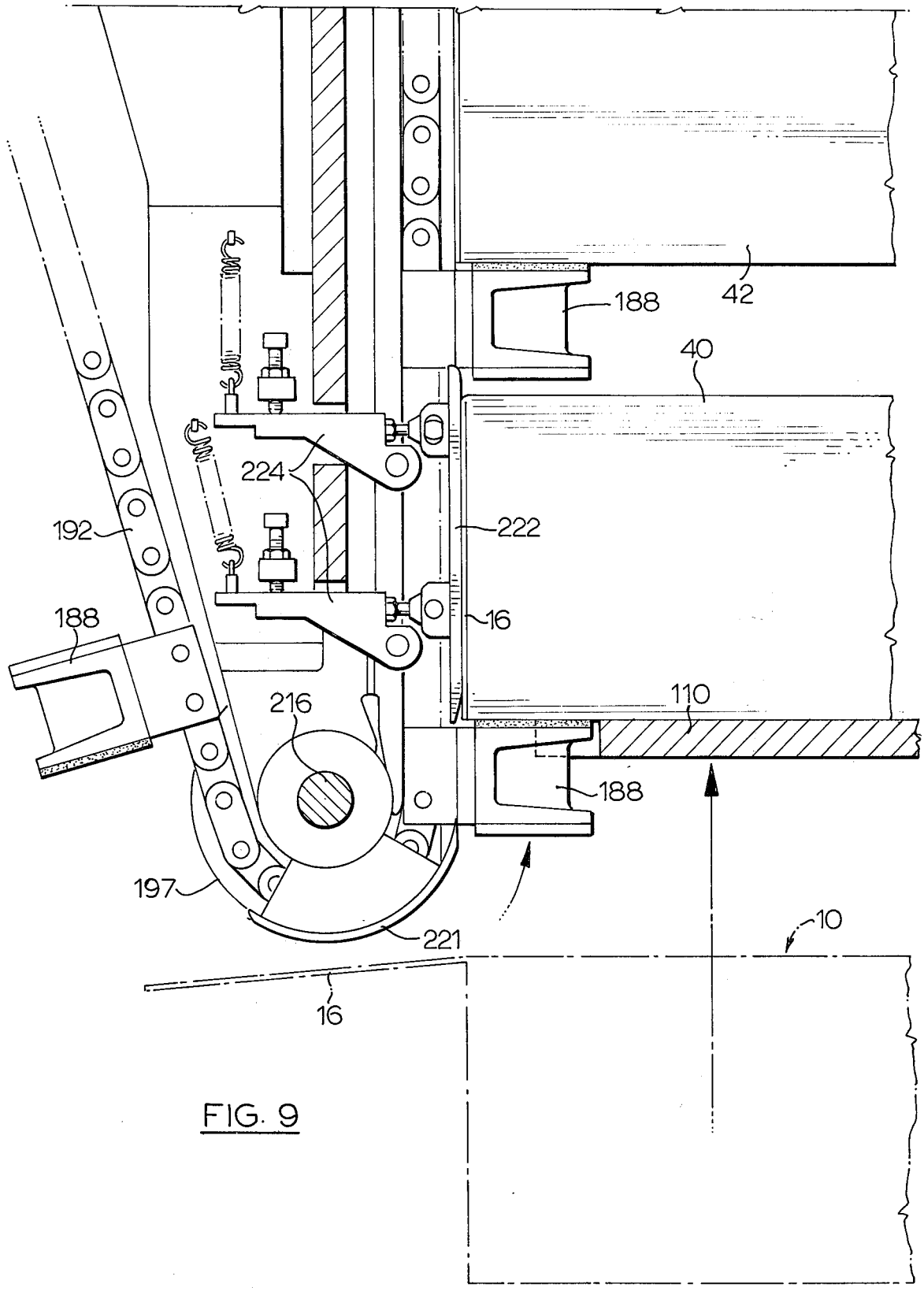
FIG. 9 is an elevational part sectional view of yet another detail of the apparatus of FIGS. 2 and 3.
Figure 10:
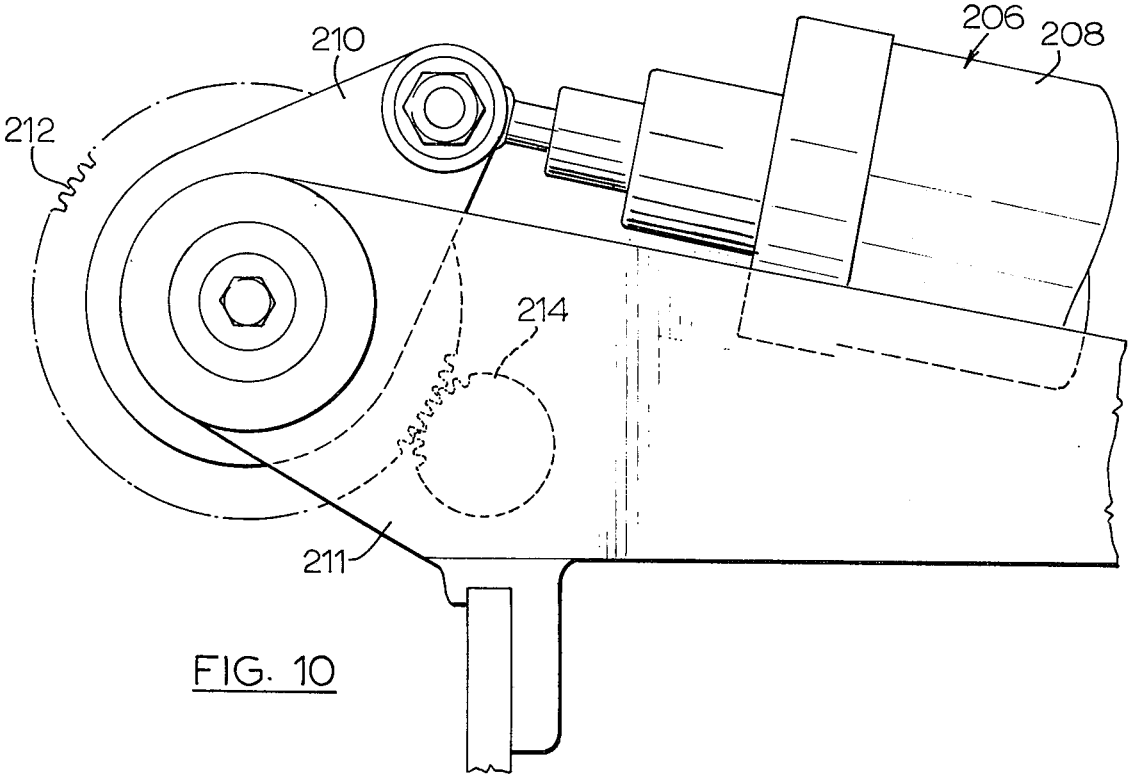
FIG. 10 is an elevational view of part of the central portion of the apparatus taken along line 10—10 of FIG. 8.

The tray supporting members 188 are spaced apart from each other on the pairs of chains 190 and 192 a linear distance slightly greater than the height of a packaging structure so that packaging structures may be spaced form each other when supported on the case supporting members 188 in the passage 187, as may be seen in the detail of FIG. 9.

Each pair of chains 190 and 192 is mounted in endless fashion around upper and lower sprocket wheels 196 and 197. Each of the chains 190 and 192 is driven simultaneously through common axles 200 and 202 mounted in frame members 23 and interconnecting gear 204, so that the tray supporting members mounted on each pair of chains 190 and 192 moves at the same speed and in phase one with another. A brake mechanism 198 is associated with the axle 200.

A drive unit 206 for pre-acceleration and drive of the chains 190 and 192 includes a pneumatic drive piston 208, a crank 210 mounted on a frame member 211 and gear wheel 212 meshing with gear wheel 214 mounted on axle 202. The gear wheel 212 includes a one-way clutch mechanism for actuation in one direction only.

Figure 3:
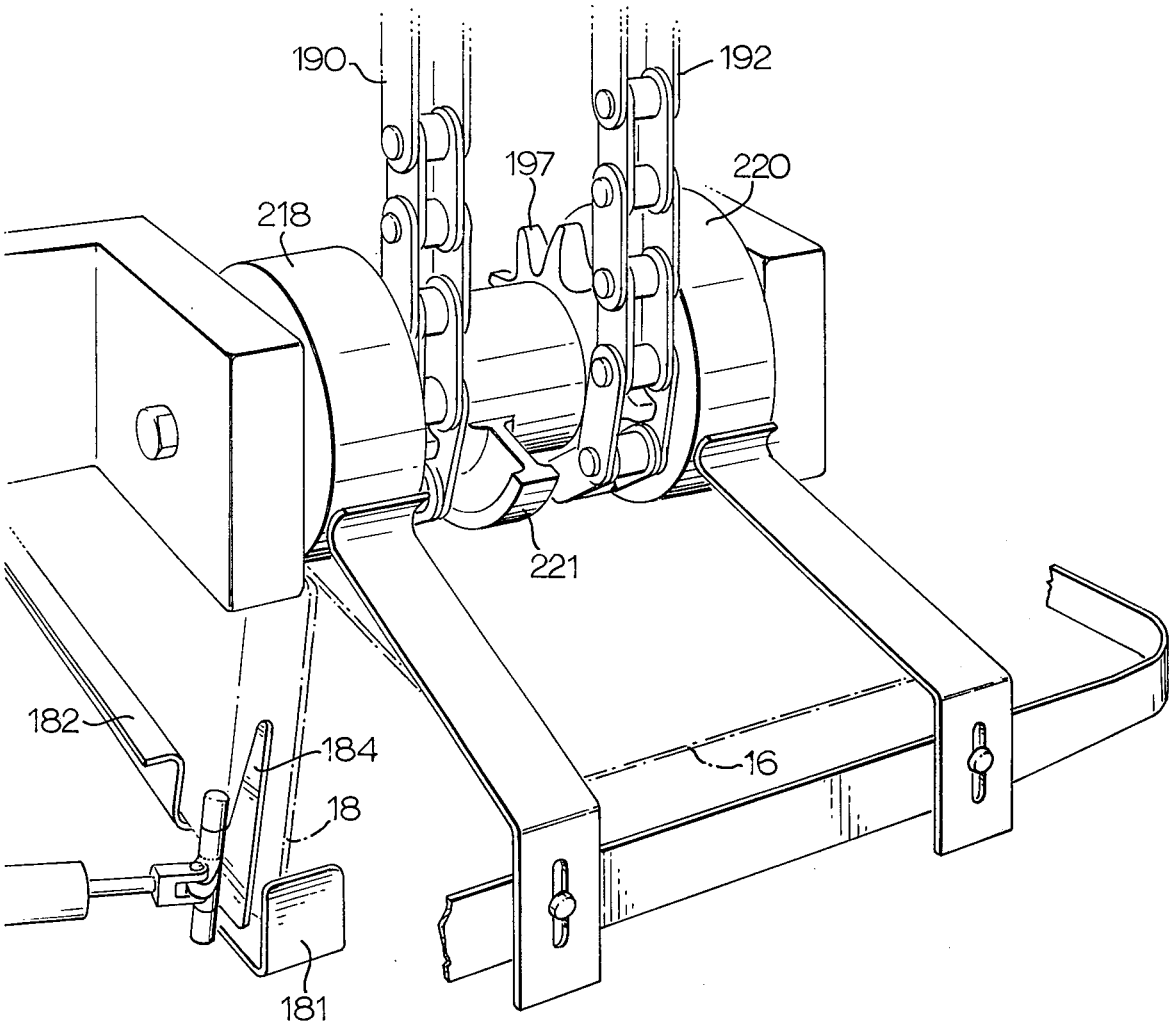
FIG. 3 is a perspective view of the apparatus of FIG. 2 from the opposite side from the view of FIG. 2.

The lower sprocket wheels 197 are mounted on axles 216, only one of which is shown (FIGS. 2, 3 and 9.) Also mounted on axles 216 in freewheeling manner or on separate axles are camming wheels 218 and 220, spaced apart on the axles a distance substantially equal to the lateral dimension of tray 24. The camming wheels 218 on opposite sides of the passage 137 are mounted so that their peripheral surfaces at the point of closest approach one to another are positioned apart a distance substantially equal to the dimension of the passage 137.

Located between the lower sprocket wheels 197 are stationary cam members 221 for engagement with the end flaps of the blank 10.

At opposed sides of the passage 187 and defining the periphery of the opposed sides are located package-structure-engaging plates 222 (only one of which is shown in FIG. 9) dimensioned to exceed marginally the lateral width of the packaging structure and the height of the packaging structure. The plates 222 are biased inwardly through the spring biasing mechanisms 224 for biased engagement with the end walls of a packaging structure situated between the plates 222.

Figure 11:
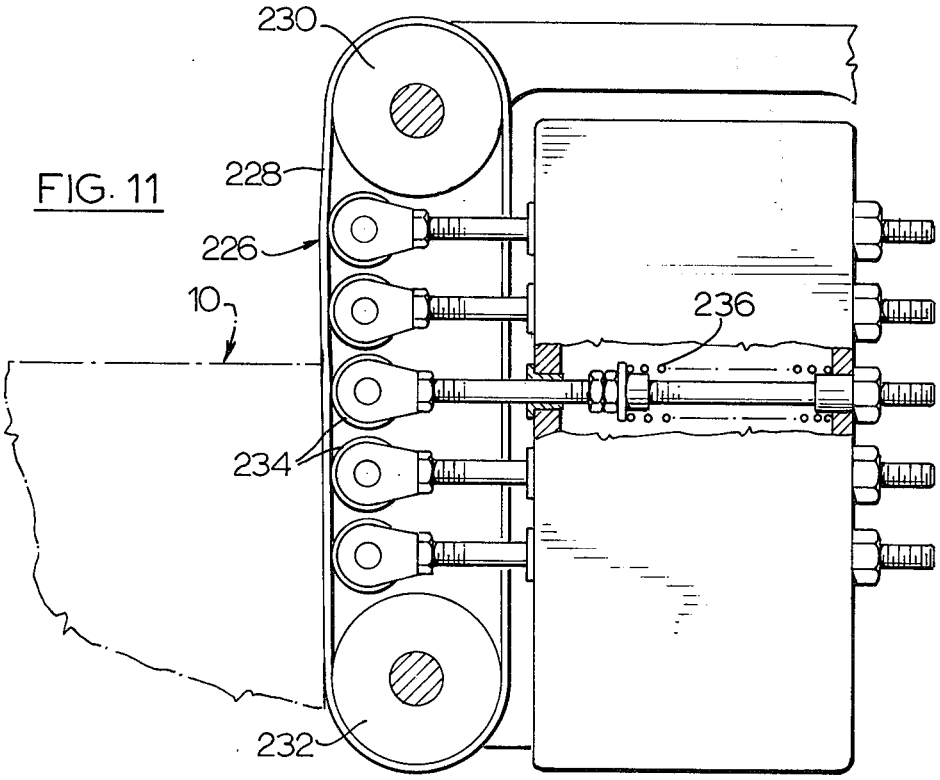
FIG. 11 is an elevation view, partly in section of a yet further detail of the apparatus of FIGS. 2 and 3.

The other opposed sides of the passage 187 include package-structure-engaging assemblies 226, only one of which is shown in FIG. 2 and illustrated in detail in FIG. 11. The assemblies 226 include an endless belt 228 of width slightly greater than the dimension of the wall of the sleeve to be engaged thereby mounted around rollers 230 and 232, the rollers 230 and 232 being mounted for free-wheeling rotation. The belt 228 has a width substantially that of the passage 187 and hence substantially that of the longitudinal dimension of the tray 24 so that the side walls of a packaging structure 38 are engaged by the belt 228.

The portion of the belt 228 which is adapted to engage the side walls of the packaging structure 28 is biased inwardly of the passage 187 by a plurality of rollers 234 under the action of springs 236. The biasing of the belts 228 and of the plates 222 to dimension the passage 187 slightly less than the cross-sectional dimension of a packaging structure to be received in the passage allows the side and end walls of the packaging structure to be gripped and pressure applied thereto during progress of the packaging structure through the passage 187.

OPERATION

In operation of the apparatus of FIGS. 2 to 11, a blank 10 is fed by wheel 154 between the cooperating belts 156 and 158 and the side panels 14 thereof are bent downwardly by the bars 160, the lower edges of the side panels 14 being positioned between the guiding and confining rods 162 for feed into the channel members 164.

The folded blank then is fed between the rails 168 and the plate 170 under the momentum of the belts 156 and 158 into position for engagement by pin 172 for feed into the assembly station 22, the undersurface of first the leading end panel 16 and then the trailing end panel 16 having adhesive applied thereto adjacent the lateral edges by the guns 180 during passage to the assembly station.

After positioning of the blank 10 at the assembly station 22, the flanges 184 are actuated to bend the flaps 18 inwardly about their crease lines, those of the trailing end of the blank 10 first being folded followed by those of the leading end, with the flanges 184 engaging the folded flaps 18 at the trailing end preventing rearward displacement of the blank 10 upon folding of the flaps 18 at the forward end.

A tray 24 is propelled on the conveyor 122 under the influence of the pusher bar 124 and is displaced from the conveyor 122 onto the platform 110 and the plates 114. During motion towards the stop 120, the leading edge of the tray 24 engages the inwardly biased brake pad 130, causing movement of the same outwardly but remaining in contact with the tray 24. The movement of the brake pad 130 under the influence of the tray 24 causes inward movement of the brake pad 132 through the biasing of the spring 146 into contact with the end wall of the tray 24. The combined action of the brake pads 130 and 132 in contact with the tray 24 causes a braking of the motion of the tray 24 which is arrested completely by the stop 120. Any rebound of the tray 24 is corrected by the second pusher bar 128 which restores the tray to its position against the stop 120.

When the blank 10 and tray 24 are positioned at the assembly station, the platform 110 is elevated until the periphery of the open top of the tray 24 engages the underside of the blank 10.

As the tray 24 lifts the blank 10, the end flaps 16 of the blank 10 engage the camming wheels 218 and 220 and stationary cam 221 and are folded downwardly about their crease lines. The assembly rises into the passage 187 and the side panels 12 engage the endless belts 226.

The blank 10 is enclosed around the tray 24 as they rise in the passage 187, the endless belts 226 pressing the side panels 14 of the blank into engagement with the side walls of the tray 24, and the camming wheels bringing the end panels 16 into contact with the tray 24 and the flaps 18, the flaps 18 coinciding with the glued portions of the end panels 16 and the portions thereof engaged by the camming wheels 218 and 220, and hence compressively spreading the glue and adhesively joining the flaps 18 to the end panels 16.

When the folding of the end panels 16 is complete, the end panels 16 engage the plates 222 as the packaging structure 38 assumes the position shown in FIG. 9.

The inward biasing of the plates 222 and the belts 226 causes the side and end panels of the blank 10 to grip the adjacent walls of the tray 24 while the adhesive dries or cures to integrate the sleeve structure.

During vertical movement of the tray and the blank into the passage 187, the tray-engaging members 188 move under the influence of motion of the driven chains 190 and 192 in timed operation so that as the packaging structure 38 assumes the position illustrated in FIG. 9, an opposed pair of tray-engaging members 188 engage the underside of the tray 24, the projections 194 passing through the castellation 112 in the platform 110.

When the packaging structure 38 is supported from below by the members 188, the platform 110 is retracted to its initial position for repeat of the blank 10 and tray 24 feeding to the assembly station 22.

During the movement of the packaging structure 38 into the passage 187, the packaging structure 38 previously located as shown in FIG. 9 and in which the adhesive has at least partially dried or cured is elevated by the members 188 to a recovery position, the packaging structures being vertically spaced apart from each other by the members 188, as seen in FIG. 9.

The final packaging structure 42, in which the blank 10 is in the form of a sleeve closing the open top of the tray 24 and in which the side panels are in frictional gripping engagement with the side walls of the tray 24 and the end panels are in frictional gripping engagement with the end walls of the tray 24, is ejected horizontally by pusher plate 238 to an assembly and dispatch area.

Figure 12:
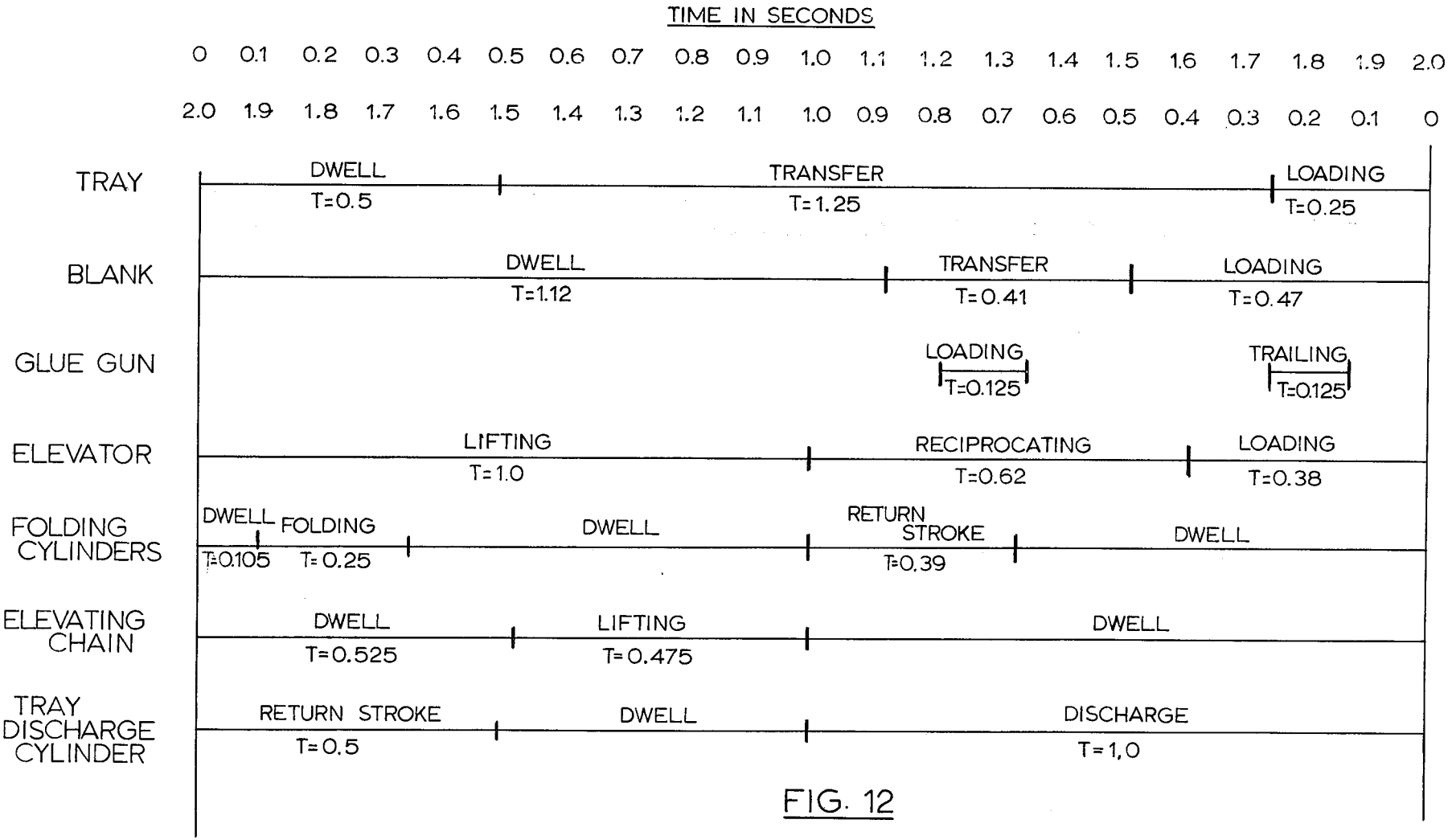
FIG. 12 is a typical timing chart for the apparatus of FIGS. 2 to 11.

The apparatus of FIGS. 2 to 11 may operate on a continuous and reliable basis to provide packaging structures 42 in rapid manner, typically producing 30 to 60 packaging structures per minute. FIG. 12 illustrates a typical timing sequence for an apparatus producing 30 packaging structures 42 per minute.

SUMMARY

The present invention, therefore, provides a method and apparatus for the provision of packaging structures in accordance with the aforesaid U.S. Pat. No. 3,815,808, which enables such structures to be produced in reliable, essentially automated manner.

Modifications are possible within the scope of the invention.

What we claim is:

1. A method of forming a packaging structure, which comprises feeding an integrally-formed planar blank for a disposable cardboard sleeve of said packaging structure in a first linear horizontal path to an assembly zone with the plane of said blank being situated substantially horizontally;

said blank comprising a rectangular central panel having first and second longitudinal side edges and first and second lateral side edges, a first rectangular side panel having a longitudinal side edge coextensive with one of said longitudinal side edges of said center panel and joined thereto by a first crease line, a second rectangular side panel having a longitudinal side edge coextensive with the other of said longitudinal side edges of said center panel and joined thereto by a second crease line, said first and second rectangular side panels each having first and second lateral side edges and a free longitudinal side edge, a first rectangular end panel having a longitudinal edge coextensive with one of said lateral side edges of said center panel and joined thereto by a third crease line, a second rectangular end panel having a longitudinal side edge coextensive with the other of said lateral side edges of said center panel and joined thereto by a fourth line, each of said rectangular end panels having a free longitudinal side edge and free lateral side edges, a first pair of flaps each of which has a side edge coextensive with one lateral side edge of said first rectangular side panel and joined thereto through a fifth crease line, a second pair of flaps each of which has a side edge coextensive with one lateral side edge of said second rectangular side panel and joined thereto through a sixth crease line, the lateral width of said side panels and said end panels being substantially equal, said blank being oriented to move longitudinally in said first horizontal path, separately feeding a substantially rigid tray in a second linear horizontal path to said assembly zone;

said tray including a rectangular bottom wall arranged with its length transverse to the direction of said second horizontal path and rectangular side walls and rectangular end walls upwardly extending from said bottom wall and terminating in an open top, the open top corresponding substantially in dimensions to said centre panel of said blank, said side walls corresponding substantially in dimensions to said side panels of said blank and said end walls corresponding substantially in dimension to said end panels of said blank;

at said assembly zone said first and second linear horizontal paths being vertically spaced-apart from each other with said first path being above said second path, bending said first and second side panels downwardly about said first and second crease lines respectively while retaining said centre panel and said end panels in said planar horizontal position during said feeding of said blank to said assembly zone, applying adhesive to the lower surface of said end panels adjacent said free lateral side edges thereof during said feeding of said blank to said assembly zone;

bending inwardly each member of each of said pairs of flaps about the fifth and sixth crease lines to a position substantially perpendicular to the respective side panel at said assembly zone;

elevating said tray in a substantially vertical path in said assembly zone to engage the lower surface of the centre panel of said blank;

elevating said tray and blank together in said vertical path while sequentially biasing said side panels into gripping engagement with the side walls of the tray and bending said end panels downwardly about said third and fourth crease lines grippingly to engage the respective end wall of the tray and to engage the respective flaps;

adhesively connecting said folded end panels to said respective flaps to provide said packaging structure wherein said side panels and said end panels grippingly engage said respective side walls and end walls of the tray to inhibit removal of said sleeve from said tray and said side panels and said end panels extend downwardly substantially the height of the respective side walls and end walls of the tray; and recovering said packaging structure.

2. The method of claim 1 wherein said first and second paths in plan view are substantially perpendicular to each other and intersect at said assembly zone.

3. The method of claim 2 operated continuously and including providing a source of said integrally formed blanks, continuously forming from said source a linear stream of longitudinally spaced-apart blanks in said first linear path, providing a source of said rigid trays, continuously forming from said source of trays a linear stream of said trays in said second linear path, continuously forming a stack of said packaging structures in said vertical path, maintaining the members of said stack in vertically spaced-apart non-touching relationship, and recovering said packaging structure by removing the topmost member of said stack.

4. The method of claim 1 wherein said adhesive is applied to the lower surface of said end panels in bead-like form, the end panels following said bending about said third and fourth crease lines are biased against the respective flaps to spread said adhesive and provide said adhesive engagement, and said adhesive connection is achieved by at least partially drying or curing the adhesive prior to recovery of said packaging structure.

5. The method of claim 1 wherein said blank includes first and second laterally spaced-apart scorings in said center panel and one of said end panels, each of said scorings extending from one lateral side edge of said centre panel to the other, at least a substantial length of one of said scorings extending adjacent and substantially parallel to one longitudinal side edge of said center panel and at least a substantial length of the other of said scorings extending adjacent and substantially parallel to the other longitudinal side edge of said centre panel, the scorings terminating in said one of said end panels and being joined together by a third scoring in said one of said end panels.

6. The method of claim 1 wherein the end walls of said tray each has a slot formed therein of larger dimension transverse of said end wall and a depression formed in each of said end walls extending from said slot towards said bottom wall.

7. An apparatus for forming a packaging structure which comprises:

an assembly station;

first conveying means for feeding an integrally-formed multiple-panel planar blank for a disposable cardboard sleeve of said packaging structure to said assembly station with the plane of said blank being situated substantially horizontally and the blank being oriented longitudinally relative to the direction of feed of the blank;

first blank panel folding means located adjacent to said first conveying means for folding selected panels of said blank downwardly;

adhesive applying means associated with said first conveying means for applying adhesive to selected portions of said blank;

second conveying means located below said first conveying means and extending substantially transverse thereto for separately feeding a substantially rigid tray to said assembly station with the tray being oriented laterally relative to the direction of feed of the tray and having an open top;

positioning means at said assembly station for locating said tray and said blank in vertically spaced-apart plan-view alignment at said assembly station;

platform means mounted for reciprocal vertical movement between a lower tray-supporting position in said assembly station and an upper position located vertically above said assembly station;

means for reciprocably moving said platform means between said lower and upper positions;

second blank panel folding means located at said assembly station for folding downwardly selected panels of said blank not folded downwardly by said first blank panel folding means;

means defining a rectangularly cross-sectioned vertically elongate passage located vertically above said assembly station for receiving packaging structures from said assembly station, said passage having cross-sectional dimensions substantially equal to those of said packaging structure;

biasing means located on and at least partially defining each side of said passage and extending upwardly at least part of the vertical height of said passage from the lower extremity of said passage for applying pressure to the outer vertical surfaces of a packaging structure located in said passage;

tray-engaging means mounted on said means defining said passage and movable upwardly through said passageway, said tray-engaging means being arranged to engage and support a tray from below when said platform is located at its upper position and to convey a packaging structure through said passage; and ejector means located adjacent the upper extremity of said passage for recovery of packaging structures conveyed therethrough by said tray-engaging means from said passage.

8. The apparatus of claim 7, wherein said first conveying means includes holding means for holding a stack of blanks, feed means for feeding blanks one at a time forwardly from said stack, upper and lower driven feed belts located downstream of said feed means and adapted to engage the upper and lower surfaces of said blank, and a driving mechanism downstream of said feed belts to convey said blank to said assembly station, and said first blank panel folding means comprises shaped bars located one on each lateral side of said feed belts and extending longitudinally thereof in position to engage the side panels of the blank and bend the same downwardly, and including panel lower edge supporting means extending longitudinally of said first conveyor means from said feed belts to said assembly station, to support the lower edge of said bent side panels during movement of said blank to said assembly station.

9. The apparatus of claim 8 wherein said adhesive-applying means includes a pair of laterally spaced-apart adhesive-applying nozzles located below the plane of movement of the blank on said first conveyor means to apply adhesive to the undersurface of the end panels of the blank adjacent their lateral edges.

10. The apparatus of claim 7 including flap-engaging elements located at said assembly station to engage and bend inwardly flaps formed on the lateral edges of the side panels of the blank.

11. The apparatus of claim 7 wherein said second conveying means includes a pusher bar for propelling a tray to said assembly station.

12. The apparatus of claim 11 wherein said positioning means at said assembly station includes stop means located at the intended extremity of movement of said tray into said assembly station, the distance between said stop means and the point of closest approach of said pusher bar to said stop means being substantially equal to the lateral dimension of the tray, said positioning means further including brake means for slowing the speed of said tray as it is fed into said assembly station.

13. The apparatus of claim 12 including a second pusher bar spaced from said first pusher bar and adapted to arrest and correct any rebound of the tray from said stop means upon engagement therewith.

14. The apparatus of claim 12 wherein said brake means includes a stationary upright wall located at one side of said assembly station and extending in the direction of movement of the tray and a brake mechanism located at the opposite side of the assembly station from said wall and cooperating therewith to produce a braking action on a tray entering said assembly station.

15. The apparatus of claim 14 wherein said brake mechanism includes a first brake pad and a second brake pad, said first brake pad being pivotally mounted at one end of a first lever arm, the other end of said first lever arm being pivotally mounted to a fixed pivot pin, said second brake pad being pivotally mounted at one end of a second lever arm, the other end of said second lever arm being pivotally mounted to said fixed pivot pin, first spring biasing means biasing said second brake pad away from said wall and second spring biasing means located between said first lever arm and second lever arm to bias said first brake pad towards said wall.

16. The apparatus of claim 7 including elongate plate means located at said assembly station cooperating with said platform means at its lower position to define a tray-engaging surface.

17. The apparatus of claim 16 wherein the sides of said platform means adjacent said plate means are castellated and said tray-engaging means have an E-shaped cross-section the projections of which are sized to pass through the castellation, whereby at said upper position of said platform means said tray-engaging means engage said tray from below, the projections passing through the castellations.

18. The apparatus of claim 7 wherein said means defining the passage includes a frame member, said second blank panel folding means comprises camming wheels mounted in freewheeling manner on said frame member for rotation about horizontal axes at the inlet mouth of said passage, said biasing means includes on one pair of opposite sides a continuous belt and inwardly biased rollers engaging the side of said belt opposite from said passage and on the other pair of sides a plate member biased inwardly of said passage.

19. The apparatus of claim 18 wherein said tray-engaging members are mounted in cooperating pairs on driven continuous chain members mounted on sprocket wheels at the top and bottom of the passage, each cooperating pair in the passage supporting a tray at the upper position of the platform means and conveying the same upwardly through the passage.

20. The apparatus of claim 19 wherein the passage is able to contain a plurality of packaging structures in stacked relation in its height and each said packaging structure is supported by a cooperating pair of tray-engaging elements whereby said tray-engaging element maintain said packaging structures spaced apart from one another in said passage.

21. The apparatus of claim 7 wherein said ejector means includes a pusher plate mounted for reciprocal movement transverse to the axis of the passage to engage and project packaging structures from the upper extremity of said passage transverse to their direction of movement through the passage for recovery of said packaging structure.

* * * * *